US011267268B2

(12) United States Patent
Ota et al.

(10) Patent No.: US 11,267,268 B2
(45) Date of Patent: Mar. 8, 2022

(54) PRINTING APPARATUS

(71) Applicant: Seiko Epson Corporation, Tokyo (JP)

(72) Inventors: Takuya Ota, Shiojiri (JP); Eiichi Ohara, Matsumoto (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 17/021,068

(22) Filed: Sep. 15, 2020

(65) Prior Publication Data

US 2020/0406650 A1 Dec. 31, 2020

Related U.S. Application Data

(62) Division of application No. 16/250,222, filed on Jan. 17, 2019, now Pat. No. 10,807,393.

(30) Foreign Application Priority Data

Jan. 18, 2018 (JP) ..... JP2018-006404

(51) Int. Cl.

| | |
|---|---|
| ***B41J 25/00*** | (2006.01) |
| ***B41J 13/00*** | (2006.01) |
| ***B41J 11/00*** | (2006.01) |
| ***B41J 2/40*** | (2006.01) |
| ***B41J 19/14*** | (2006.01) |
| ***B41J 19/20*** | (2006.01) |
| ***B41J 3/407*** | (2006.01) |

(52) U.S. Cl.

CPC ..... *B41J 25/006* (2013.01); *B41J 3/4078* (2013.01); *B41J 11/0035* (2013.01); *B41J 13/0063* (2013.01); *B41J 19/145* (2013.01); *B41J 19/205* (2013.01)

(58) Field of Classification Search

CPC .... B41J 25/006; B41J 3/4078; B41J 11/0035; B41J 13/0063

See application file for complete search history.

(56) References Cited

U.S. PATENT DOCUMENTS

| | | | | |
|---|---|---|---|---|
| 9,193,152 | B2 | 11/2015 | Miller | |
| 9,248,665 | B2 | 2/2016 | Yamada | |
| 2011/0109693 | A1 | 5/2011 | Ohnishi | |
| 2015/0097883 | A1* | 4/2015 | Tamai | B41J 2/16538 347/9 |

FOREIGN PATENT DOCUMENTS

| | | |
|---|---|---|
| JP | 2000-071539 A | 3/2000 |
| JP | 2007-098866 A | 4/2007 |

* cited by examiner

*Primary Examiner* — Jason S Uhlenhake

(74) *Attorney, Agent, or Firm* — Harness, Dickey & Pierce, P.L.C.

(57) ABSTRACT

A printing apparatus includes: a head portion that discharges droplets toward a printing medium while reciprocating on the printing medium; and a controller that controls movement of the head portion during a printing operation such that a movement stop time of the head portion when a movement direction of the head portion is reversed at an endmost portion of a range in which the head portion moves is longer than the movement stop time of the head portion when the movement direction of the head portion is reversed on the printing medium.

2 Claims, 7 Drawing Sheets

| PRINTING MODE | PLATEN GAP (mm) | MOVING VELOCITY (m/s) | MOVEMENT STOP TIME (ms) |
|---|---|---|---|
| FIRST PRINTING MODE | 2.0 | 1.0 | 30 |
| SECOND PRINTING MODE | 3.0 | 1.0 | 150 |
| THIRD PRINTING MODE | 3.0 | 0.8 | 120 |
| FOURTH PRINTING MODE | 3.0 | 1.2 | 180 |

PRINTING APPARATUS

CROSS-REFERENCE TO RELATED APPLICATIONS

This application is a divisional of U.S. patent application Ser. No. 16/250,222, filed Jan. 17, 2019, which claims priority to Japanese Patent Application No. 2018-006404, filed Jan. 18, 2018, the entire disclosures of which are hereby expressly incorporated by reference herein in their entireties.

BACKGROUND

1. Technical Field

The present invention relates to a printing apparatus.

2. Related Art

In recent years, types of media, such as cloth, a cardboard, and an acrylic board, required to be printed by a printing apparatus increase. In order to deal with such various kinds of printing media, a configuration of the printing apparatus has been known in which an interval between a platen supporting a printing medium or the printing medium and a head portion can be changed according to the types of the media (for example, see JP-A-2016-182722).

In order to deal with such various kinds of printing media, it is preferable that an interval between a platen or a printing medium and a head portion can be set large. However, the inventor of the invention has found a problem greatly affecting printing quality in that when the interval between the platen or the printing medium and the head portion increases or a moving velocity increases while the head portion reciprocates, droplets ejected immediately after a movement direction of the head portion is reversed are greatly affected by immediately previous movement of the head portion, and thus printing quality is greatly affected, and thus a ruled line is double-printed.

SUMMARY

The invention can be realized in the following aspects or application examples.

(1) According to an aspect of the invention, a printing apparatus is provided. The printing apparatus includes: a platen that supports a printing medium; a head portion that discharges droplets toward the printing medium while reciprocating on the printing medium; an interval adjusting mechanism that adjusts an interval between the platen and the head portion; and a controller that controls the head portion and the interval adjusting mechanism. Further, the controller may have a first printing mode in which printing is performed while the interval is set to a first interval and a second printing mode in which the printing is performed while the interval is set to a second interval that is larger than the first interval, as a printing mode in which the printing is performed on the printing medium. The controller may control movement of the head portion such that a movement stop time of the head portion when a movement direction of the head portion is reversed is longer in the second printing mode than in the first printing mode.

According to the printing apparatus, as the interval between the platen and the head portion increases, the movement stop time of the head portion increases. Therefore, as the interval between the head portion and the platen becomes larger, even when airflow between the head portion and the platen is not completely attenuated immediately after movement is stopped during the reverse motion of the head portion, the movement of the head portion is stopped, so that the airflow can be sufficiently attenuated. As a result, influence of the airflow on the droplets ejected after the reverse motion of the head portion can be suppressed, and printing quality can be improved.

(2) In the printing apparatus, the controller may acquire a distance between the head portion and the printing medium, and adjust the interval using the interval adjusting mechanism such that the distance between the head portion and the printing medium is constant irrespective of a thickness of the printing medium. With this configuration, since the interval between the head portion and the printing medium is constant irrespective of types the printing medium, variation in the printing quality can be suppressed.

(3) According to another aspect of the invention, a printing apparatus is provided. The printing apparatus includes: a head portion that discharges droplets toward a printing medium while reciprocating on the printing medium; and a controller that acquires a distance between the head portion and the printing medium, and controls movement of the head portion such that a movement stop time of the head portion when a movement direction of the head portion is reversed is set to be longer as the distance becomes larger.

According to the printing apparatus, as the distance between the head portion and the printing medium increases, the movement stop time of the head portion may increase. Therefore, as the distance between the head portion and the printing medium becomes larger, even when the airflow between the head portion and the printing medium is not completely attenuated immediately after movement is stopped during the reverse motion of the head portion, the movement of the head portion may be stopped, so that the airflow can be sufficiently attenuated. As a result, influence of the airflow on the droplets ejected after the reverse motion of the head portion can be suppressed, and the printing quality can be improved.

(4) In the printing apparatus, when the movement direction of the head portion is reversed, the controller may shorten a time from when the head portions starts to move to when the droplets are ejected to the printing medium, as the distance increases. With this configuration, the droplets can be discharged at an appropriate timing according to the distance between the head portion and the printing medium.

(5) The printing apparatus may further include a distance measuring unit that measures the distance. With this configuration, the interval between the head portion and the platen can be adjusted and the movement of the head portion can be controlled, based on a measured value of the distance between the head portion and the printing medium.

(6) According to still another aspect of the invention, a printing apparatus is provided. A printing apparatus includes: a head portion that discharges droplets toward a printing medium while reciprocating on the printing medium; and a controller that controls movement of the head portion during a printing operation such that a movement stop time of the head portion when a movement direction of the head portion is reversed at an endmost portion of a range in which the head portion moves is larger than the movement stop time of the head portion when the movement direction of the head portion is reversed on the printing medium.

According to the printing apparatus, the movement stop time of the head portion becomes longer at an endmost portion having an interval that is larger than the interval between the head portion and the printing medium. Therefore, when a space below the head portion is large in the endmost portion, even when the airflow in the space is not completely attenuated immediately after the movement is stopped during the reverse motion of the head portion, the movement of the head portion may be stopped, so that the airflow can be sufficiently attenuated. As a result, influence of the airflow on the droplets ejected after the reverse motion of the head portion can be suppressed, and the printing quality can be improved.

(7) According to still another aspect of the invention, a printing apparatus is provided. The printing apparatus includes: a head portion that discharges droplets toward a printing medium while reciprocating on the printing medium; and a controller that controls the head portion. The controller may have a third printing mode in which the head portion moves at a first moving velocity and a fourth printing mode in which the head portion moves at a second moving velocity that is faster than the first moving velocity. The controller may control movement of the head portion such that a movement stop time of the head portion when a movement direction of the head portion is reversed is longer in the fourth printing mode than in the third printing mode.

According to the printing apparatus, in the printing mode in which the moving velocity of the head portion is faster, the movement stop time of the head portion becomes longer. Therefore, as the moving velocity of the head portion increases, even when the airflow in the space below the head portion is not completely attenuated immediately after movement is stopped during the reverse motion of the head portion, the movement of the head portion may be stopped, so that the airflow can be sufficiently attenuated. Therefore, influence of the airflow on the droplets ejected after the reverse motion of the head portion can be suppressed, and the printing quality can be improved.

(8) The printing apparatus may further include a medium transporting mechanism that transports the printing medium in a direction intersecting the movement direction of the head portion, and the controller may stop the movement of the head portion for a longer time of the movement stop time of the head portion when the movement direction of the head portion is reversed and a medium transporting time required for transporting the printing medium using the medium transporting mechanism when the movement direction of the head portion is reversed. With this configuration, irrespective of the length of the medium transporting time, the influence of the airflow on the ejection of the ink droplets after the reverse motion of the head portion can be suppressed, and the printing quality can be improved.

The invention can be realized in various forms in addition to a form as the above-described printing apparatus. For example, the invention can be realized in a computer program for controlling a printing method or a printing apparatus or a non-transitory tangible storage medium in which the computer program is stored.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
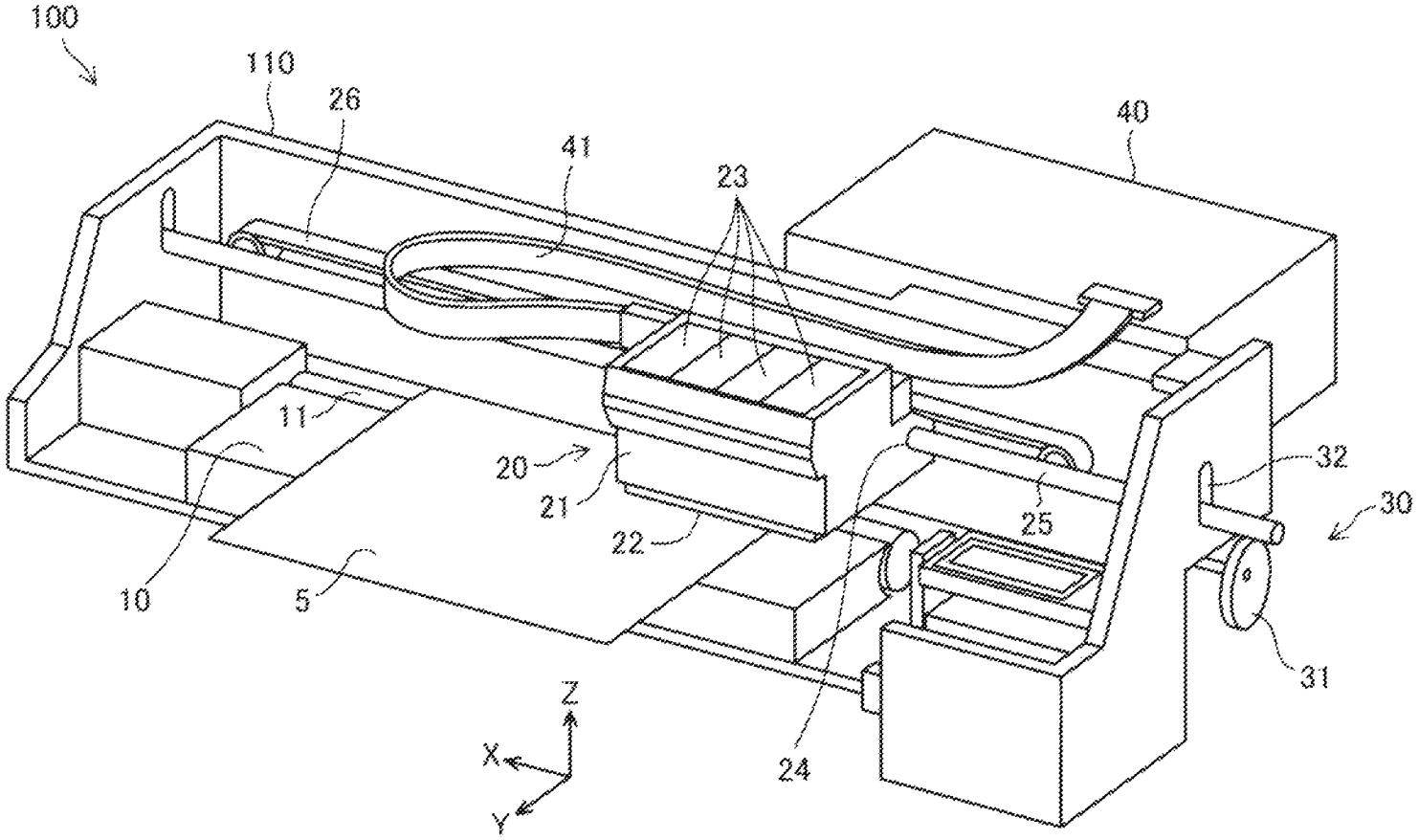
FIG. 1 is a perspective view illustrating a schematic configuration of a printing apparatus according to a first embodiment.

FIG. 1 is a perspective view illustrating a schematic configuration of a printing apparatus 100 according to a first embodiment. The printing apparatus 100 is configured as a serial ink jet printer that performs printing by ejecting inks onto a printing medium 5. The printing apparatus 100 includes a platen 10, a head portion 20, an interval adjusting mechanism 30, and a controller 40. The printing apparatus 100 can perform printing on various media such as a printing paper, a cloth, a cardboard, and an acrylic board, as the printing medium 5.

An X direction, a Y direction, and a Z direction which are perpendicular to each other are illustrated in FIG. 1. These directions are illustrated in figures after FIG. 1 as needed. In the present embodiment, a +X direction is a forward direction in a direction in which the head portion 20 reciprocates, and a −X direction is a rearward direction in the direction in which the head portion 20 reciprocates. A +Y direction is a direction in which the printing medium 5 is transported and a −Y direction is a reverse direction thereto. A +Z direction is a vertically upward direction, and a −Z direction is a vertically downward direction. Hereinafter, the +Z direction is referred to as an "upward direction", and the −Z direction is referred to as a "downward direction". The X direction, the Y direction, and the Z direction may not be strictly perpendicular to each other, and may be inclined within a range in which an operation of the printing apparatus 100 is not affected.

The platen 10 has a surface formed along the X direction and the Y direction, and supports the printing medium 5 from below on the surface. A platen roller 11 is provided near the platen 10 as a medium transporting mechanism. The platen roller 11 transports the printing medium 5 to a direction intersecting a movement direction of the head portion 20. The platen roller 11 is driven by a not-illustrated transporting motor. As the platen roller 11 is driven by the transporting motor, the printing medium 5 is transported on the platen 10 in the +Y direction. The driving of the transporting motor is controlled by the controller 40.

The head portion 20 ejects droplet-like inks to the printing medium 5. The head portion 20 includes a carriage 21, a nozzle group 22 provided on a lower surface of the carriage 21, and a plurality of ink cartridges 23 detachably mounted on the carriage 21. The plurality of ink cartridges 23 contain different types or colors of inks. The printing apparatus 100 of the present embodiment is a piezo-type printing apparatus 100, and each nozzle constituting the nozzle group 22 includes a piezo element for applying a pressure to the inks. As the piezo elements are driven by the controller 40, the inks contained in the ink cartridges 23 are ejected from the nozzle group 22 provided on the lower surface of the carriage 21 to the printing medium 5. Hereinafter, the lower surface of the carriage 21 is referred to as a "nozzle surface". The plurality of nozzles are arranged for the different types or colors of inks along the Y direction on the nozzle surface. The printing apparatus 100 is not limited to the piezo type, and may be a thermal type printing apparatus. Further, the ink cartridges 23 may be disposed any positions of a housing 110 of the printing apparatus 100, and may be connected to the head portion 20 by tubes in which the inks flow.

A support hole 24 is formed in the carriage 21 along the X direction. A guide shaft 25 provided in the housing 110 of the printing apparatus 100 along the X direction is inserted through the support hole 24. Further, an endless timing belt 26 is connected to the carriage 21. The timing belt 26 is driven by a not-illustrated carriage motor. As power of the carriage motor is transmitted to the carriage 21 through the timing belt 26, the head portion 20 reciprocates on the printing medium 5 along the guide shaft 25. Driving of the carriage motor is controlled by the controller 40.

The interval adjusting mechanism 30 adjusts an interval between the platen 10 and the head portion 20. The interval adjusting mechanism 30 includes a cam 31 for adjusting a position of the guide shaft 25 inserted through the carriage 21 in the Z direction. The cam 31 is driven by a not-illustrated cam motor. When the cam 31 is driven, the guide shaft 25 supported by the cam 31 from below moves inside a guide hole 32 formed in the housing 110 of the printing apparatus 100 along the Z direction. Accordingly, the interval between the platen 10 and the head portion 20 is adjusted. The driving of the cam motor is controlled by the controller 40. The configuration of the interval adjusting mechanism 30 is not limited to such a configuration, and may adopt various configurations in which the guide shaft 25 is raised and lowered.

The controller 40 controls the head portion 20 and the interval adjusting mechanism 30. The controller 40 is connected to the head portion 20 through a flexible cable 41. Further, the controller 40 is connected to the carriage motor, the transporting motor, and the cam motor. The controller 40 controls such motors and the driving of the piezo element included in the head portion 20, to eject the inks at predetermined positions on the printing medium 5 and to perform the printing on the printing medium 5. The controller 40 includes a central processing unit (CPU) and a memory. The CPU executes a control program stored in the memory to perform control for the printing. The control program may be stored in various storage media.

Figure 2:
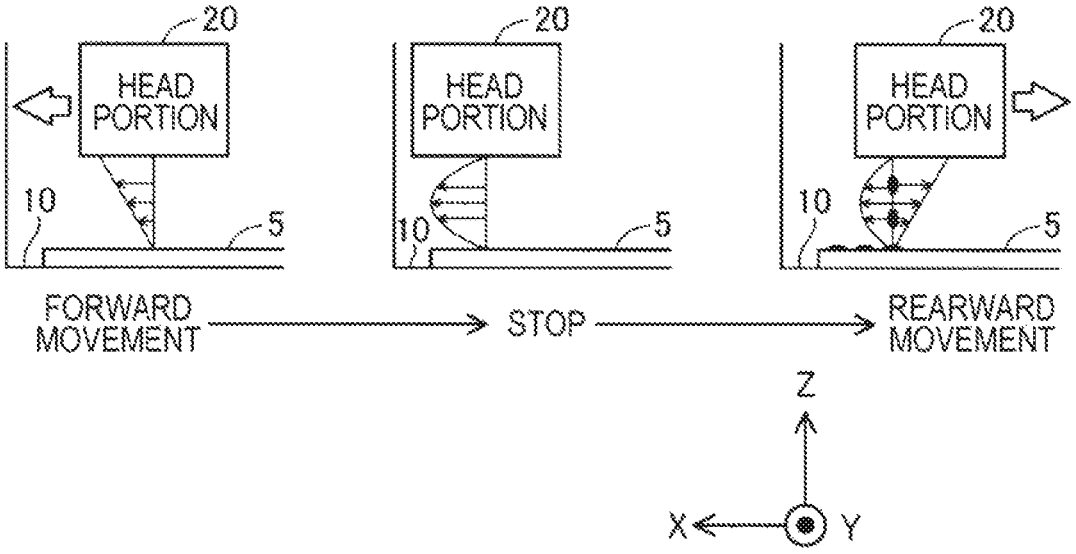
FIG. 2 is a diagram illustrating a relationship between movement of a head portion and airflow.
Figure 3:
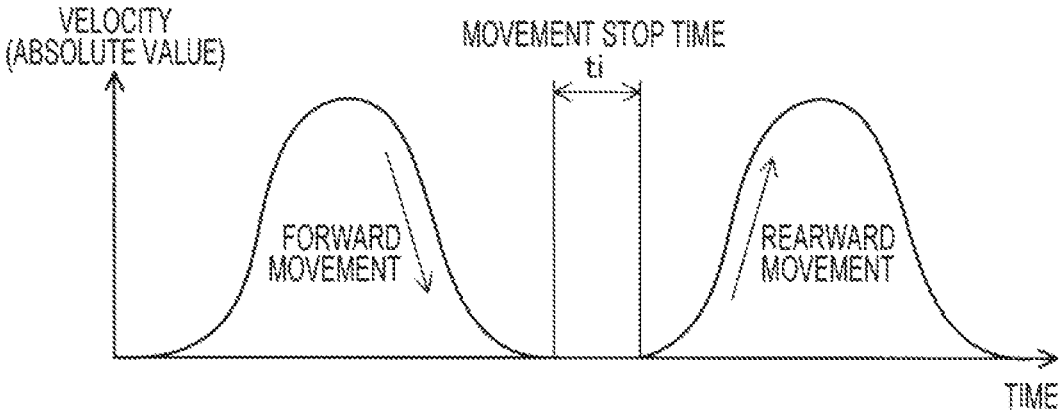
FIG. 3 is a graph depicting a moving velocity of the head portion.

FIG. 2 is a diagram illustrating a relationship between movement of the head portion 20 and airflow. FIG. 3 is a graph depicting a moving velocity of the head portion 20. As illustrated in FIGS. 2 and 3, the head portion 20 reciprocates on the printing medium 5 on the X direction. The head portion 20 ejects ink droplets downward during at least one of forward movement and rearward movement. An element that ejects the ink droplets during the rearward movement is illustrated in FIG. 2. The ink droplets ejected from the head portion 20 cause airflow between the head portion 20 and the printing medium 5, to involve ambient air during a flight movement. Further, since the head portion 20 reciprocates in the X direction, air collides with a side surface of the head portion 20. Then, a part of the air flows between the head portion 20 and the printing medium 5. Further, a shear flow occurs in the air between the head portion 20 and the printing medium 5 due to a relative movement between the nozzle surface of the head portion 20 and the printing medium 5 when the head portion 20 reciprocates. The flow of the air caused by these reasons is indicated by an arrow along the X direction in FIG. 2. As a distance between the head portion 20 and the printing medium 5 increases, the flow of the air between the head portion 20 and the printing medium 5 becomes nonnegligible, the flight paths of the ink droplets are bent, and the impact positions of the ink droplets deviate from the printing medium 5, which may be a cause of deterioration in printing quality.

Figures 4, 5:
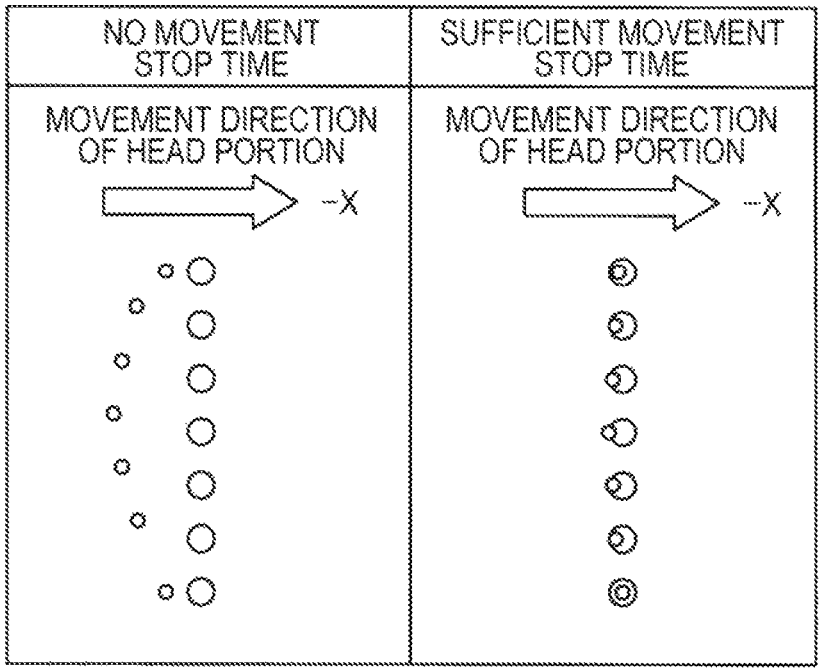
FIG. 4 is a diagram illustrating a difference in a printing result according to whether or not there is a movement stop time of the head portion.
FIG. 5 is a diagram illustrating an example of a printing mode provided in a controller.

FIG. 4 is a diagram illustrating a difference in a printing result according to whether or not there is a movement stop time of the head portion 20. A printing result obtained by ejecting one-color ink droplets to the printing medium 5 from the plurality of nozzles arranged on the nozzle surface of the head portion 20 along the Y direction immediately after the movement direction is reversed from the forward direction to the rearward direction is schematically illustrated in FIG. 4. The movement stop time (see FIG. 3) is a time during which the head portion 20 stops movement thereof between the forward movement and the rearward movement or between the rearward movement and the forward movement when the movement of the head portion 20 is reversed. The printing result obtained when the movement stop time ti is set to zero, that is, when the rearward movement is immediately performed after the forward movement, is illustrated on a left side of the drawing. When the movement stop time is set to zero, a curved thin line is formed by ink droplets called satellite droplets, separated from main ink droplets, and having small weights, on a left side of a straight line formed by the main ink droplets. As described above, when the satellite droplets impact on positions that are different from positions of the main ink droplets, for example, when a ruled line is printed along the Y direction, a doubled ruled line is observed. The deviation of the impact positions becomes more conspicuous as the distance between the head portion 20 and the printing medium 5 increases and the moving velocity of the head portion 20 increases. In contrast, as illustrated on a right side of the drawing, when the movement stop time ti is set sufficient, the satellite droplets impact on substantially the same positions as the main ink droplets, and thus the ruled line is not doubled. Therefore, in the present embodiment, when the movement direction of the head portion 20 is folded back, the movement of the head portion 20 is stopped, so that the airflow between the head portion 20 and the printing medium 5 after the reverse motion of the head portion 20 is prevented from influencing on the printing quality. Although an example where the impact positions of the satellite droplets deviate is illustrated in FIG. 4, deviation of the impact positions of the main ink droplets occurs due to a weight and a flight velocity thereof and the influence of the air flow. In determination on whether or not the ruled line is doubled, when intervals between the impact positions of the main ink droplets and the impact positions of the satellite droplets are measured, and the intervals are equal to or more than 100 μm, it is determined that the ruled line is doubled.

FIG. 5 is a diagram illustrating an example of a printing mode provided in the controller 40. In the present embodiment, the controller 40 includes a first printing mode and a second printing mode as a printing mode. In the first printing mode, the interval (hereinafter, referred to as a "platen gap") between the head portion 20 and the platen 10 is 2.0 mm, the moving velocity of the head portion 20 is 1.0 m/s, and the movement stop time ti is 30 ms. In contrast, in the second printing mode, the platen gap is 3.0 mm, the moving velocity of the head portion 20 is 1.0 m/s, and the movement stop time ti is 150 ms. That is, the controller 40 has the "first printing mode" in which the printing is performed while the platen gap is set to a first interval (2.0 mm), and the "second printing mode" in which the printing is performed while the platen gap is set to a second interval (3.0 mm) that is larger than the first interval. For example, a user designates the first printing mode when the printing is performed on a general printing sheet, and designates the second printing mode when the printing is performed on the thick printing medium 5. The movement stop time of each printing mode is set by previously obtaining a time at which a doubled ruled line is not generated as illustrated in FIG. 4, by previously performing experiment and simulation according to the platen gap and the moving velocity of the head portion 20. The "moving velocity" illustrated in FIG. 5 represents a maximum value of an absolute value of a velocity. Further, numerical values illustrated in FIG. 5 are examples, and various values can be applied.

The controller 40 designates, by the user, a printing mode from a predetermined user interface provided in the printing apparatus 100 and a setting screen of a computer connected to the printing apparatus 100, controls the interval adjusting mechanism 30 to adjust the platen, based on each parameter associated with the designated printing mode, and controls the moving velocity and the movement stop time of the head portion 20 during a printing operation. Accordingly, when the first printing mode or the second printing mode is designated, the controller 40 controls movement of the head portion 20 during the printing operation such that the movement stop time ti of the head portion 20 when the movement direction of the head portion 20 is reversed is set to be longer in the second printing mode having the large platen gap than in the first printing mode having the small platen gap.

As illustrated in FIG. 5, the controller 40 further includes a third printing mode and a fourth printing mode as a printing mode. In the third printing mode, the platen gap is 3.0 mm, the moving velocity of the head portion 20 is 0.8 m/s, and the movement stop time ti is 120 ms. In contrast, in the fourth printing mode, the platen gap is 3.0 mm, the moving velocity of the head portion 20 is 1.2 m/s, and the movement stop time ti is 180 ms. That is, the controller 40 includes the "third printing mode" in which the head portion 20 is moved at a first moving velocity (0.8 m/s) and the "fourth printing mode" in which the head portion 20 is moved at a second moving velocity (1.2 m/s) that is faster than the first moving velocity. When the third printing mode or the fourth printing mode is designated, the controller 40 controls movement of the head portion 20 during the printing operation such that the movement stop time ti of the head portion 20 when the movement direction of the head portion 20 is reversed is set to be longer in the fourth printing mode having the fast moving velocity than in the third printing mode having the slow moving velocity.

According to the above-described printing apparatus 100 of the present embodiment, as the interval (the platen gap) between the platen 10 and the head portion 20 becomes larger, the movement stop time ti of the head portion 20 is set to be larger. Therefore, as the interval between the head portion 20 and the platen 10 becomes larger, even when airflow between the head portion 20 and the platen 10 is not completely attenuated immediately after movement is stopped during the reverse motion of the head portion 20, the movement stop time ti of the head portion 20 is set to be large, so that the airflow can be sufficiently attenuated. As a result, since influence of the airflow on the ink droplets ejected after the reverse motion of the head portion 20 can be suppressed, the deviation of the impact positions of the ink droplets can be suppressed, and the printing quality can be improved.

Further, in the present embodiment, in the printing mode in which the moving velocity of the head portion 20 is faster, the movement stop time ti of the head portion 20 is set to be larger. Therefore, as the moving velocity of the head portion 20 increases, even when the airflow between the head portion 20 and the platen 10 is not completely attenuated immediately after movement is stopped during the reverse motion of the head portion 20, the movement stop time ti of the head portion 20 is set to be large, so that the airflow can be sufficiently attenuated. As a result, since influence of the airflow on the ink droplets ejected after the reverse motion of the head portion 20 can be suppressed, the deviation of the impact positions of the ink droplets can be suppressed, and the printing quality can be improved.

In the present embodiment, the controller 40 may not include all the four printing modes illustrated in FIG. 5. For example, the controller 40 may include only the first printing mode and the second printing mode. Further, the controller 40 may include only the third printing mode and the fourth printing mode. Further, the controller 40 may include another printing mode having a different platen gap and a different moving velocity in addition to the four printing modes. When the controller 40 does not include the first printing mode and the second printing mode among the printing modes illustrated in FIG. 5, the interval adjusting mechanism 30 may be omitted from a configuration of the printing apparatus 100, and the interval between the head portion 20 and the platen 10 may be fixed.

B. Second Embodiment

In the above-described first embodiment, the controller 40 controls the interval adjusting mechanism 30 depending on the printing mode designated by the user, to adjust the platen gap. In contrast, in the second embodiment, the controller 40 adjusts the platen gap according to the thickness of the printing medium 5 without designating the printing mode by the user.

Figure 6:
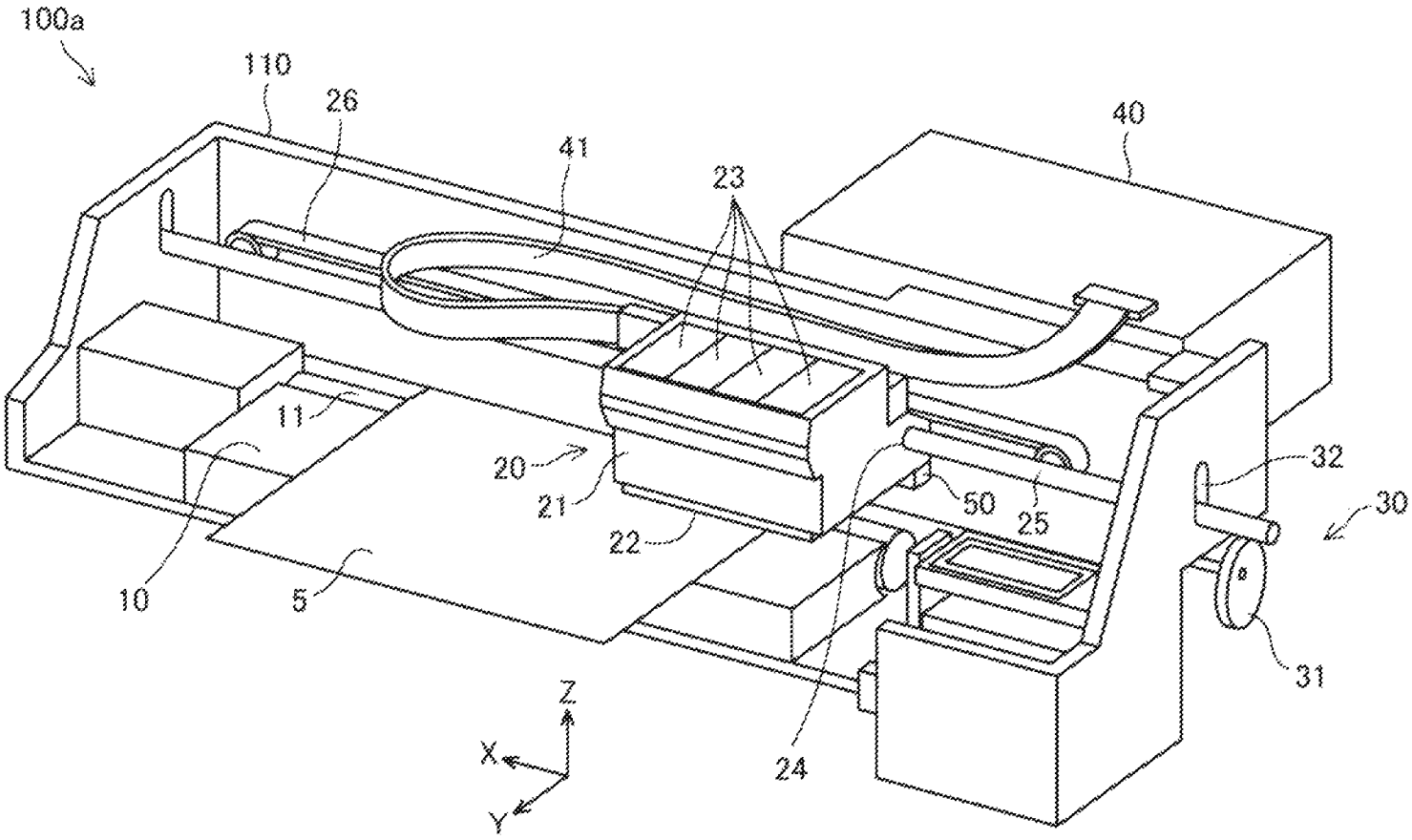
FIG. 6 is a perspective view illustrating a schematic configuration of a printing apparatus according to a second embodiment.

FIG. 6 is a perspective view illustrating a schematic configuration of a printing apparatus 100*a* according to the second embodiment. The printing apparatus 100*a* according to the second embodiment is different from the printing apparatus 100 illustrated in FIG. 1 according to the first embodiment in that the former includes a distance measuring unit 50 for measuring the distance between the head portion 20 and the printing medium 5, and the other configurations are the same. Hereinafter, the same configurations in the printing apparatus 100*a* and the printing apparatus 100 will be described using the same reference numerals.

The distance measuring unit 50 has a sensor for measuring the distance between the head portion 20 and the printing medium 5. In the present embodiment, the distance measuring unit 50 is provided on a lower surface of the carriage 21.

Various sensors such as a non-contact sensor that optically measures the distance between the head portion 20 and the printing medium 5 and a contact sensor that measures the distance by bringing a probe or the like into the printing medium 5 may be used as the sensor for measuring the distance. Prior to the printing on the printing medium 5, the controller 40 measures the distance between the head portion 20 and the printing medium 5 using the distance measuring unit 50 while moving the head portion 20. The distance measured by the distance measuring unit 50 is acquired by the controller 40. Hereinafter, the distance between the head portion 20 and the printing medium 5 is referred to as a "paper gap". The paper gap may be measured at a predetermined position or may be calculated as an average value obtained by measurement at a plurality of positions. In the present embodiment, although the distance measuring unit 50 is provided in the head portion 20, the distance measuring unit 50 may be fixed to the housing 110 of the printing apparatus 100 as long as the fixed position is an upstream side of the head portion 20 on a transport path of the printing medium 5.

Figure 7:
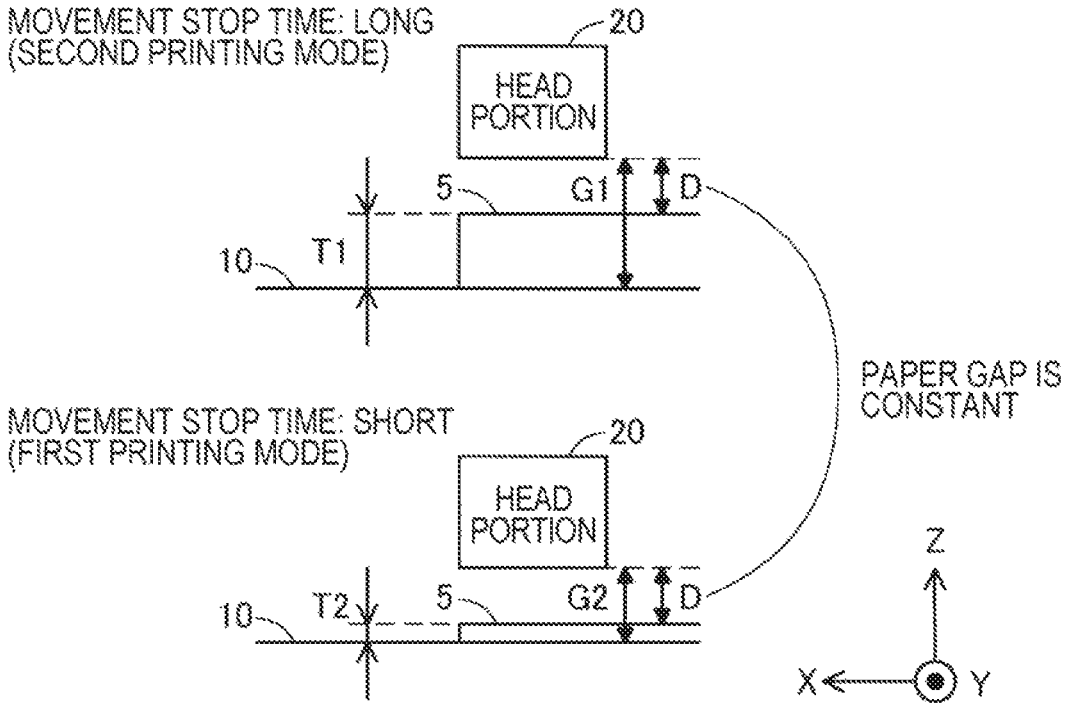
FIG. 7 is a diagram illustrating control contents of a controller according to the second embodiment.

FIG. 7 is a diagram illustrating control contents of the controller 40 according to the present embodiment. In the present embodiment, prior to the printing, the controller 40 measures a paper gap D using the distance measuring unit 50 as described above. Further, the controller 40 controls the interval adjusting mechanism 30, such that the paper gap D is constant irrespective of the thicknesses T1 and T2 of the printing medium 5, to set a height (the platen gap) of the head portion 20 with respect to the platen 10. In this way, since the interval between the head portion 20 and the printing medium 5 is constant irrespective of types of the printing medium 5, variation in the printing quality can be suppressed.

When the platen gap is adjusted such that the paper gap D is constant irrespective of the thickness of the printing medium 5, the platen gap is larger when the thickness of the printing medium 5 is large (the thickness T1) than when the thickness of the printing medium 5 is small (the thickness T2) (G1>G2). Therefore, in the present embodiment, the controller 40 controls the movement of the head portion 20 during the printing such that the movement stop time ti of the head portion 20 when the movement direction of the head portion 20 is reversed becomes longer as the platen gaps become larger, that is, the movement stop time ti becomes longer as the thickness of the printing medium 5 becomes larger. In this way, even when the platen gap increases as the paper gap is kept constant, the movement stop time ti increases, so that the airflow can be sufficiently suppressed. Therefore, influence of the airflow on the ejection of the ink droplets after the reverse motion of the head portion 20 can be suppressed, and the printing quality can be improved.

In the present embodiment, when the thickness of the printing medium 5 is small, the platen gap becomes small. Thus, the printing mode when the thickness of the printing medium 5 is small corresponds to the first printing mode in the first embodiment. Further, in the present embodiment, when the thickness of the printing medium 5 is large, the platen gap becomes large. Thus, the printing mode when the thickness of the printing medium 5 is large corresponds to the second printing mode in the first embodiment. That is, even in the present embodiment, like the first embodiment, the controller 40 controls the head portion 20 such that the movement stop time ti of the head portion 20 when the movement direction of the head portion 20 is reversed is set to be longer in the second printing mode than in the first printing mode.

C. Third Embodiment

In the above-described first embodiment, the platen gap and the movement stop time are set according to the printing mode designated by the user. In contrast, in the third embodiment, the movement stop time is set based on the paper gap measured using the distance measuring unit 50. A configuration of a printing apparatus according to the third embodiment is the same as the printing apparatus 100*a* (FIG. 6) according to the second embodiment.

Figure 8:
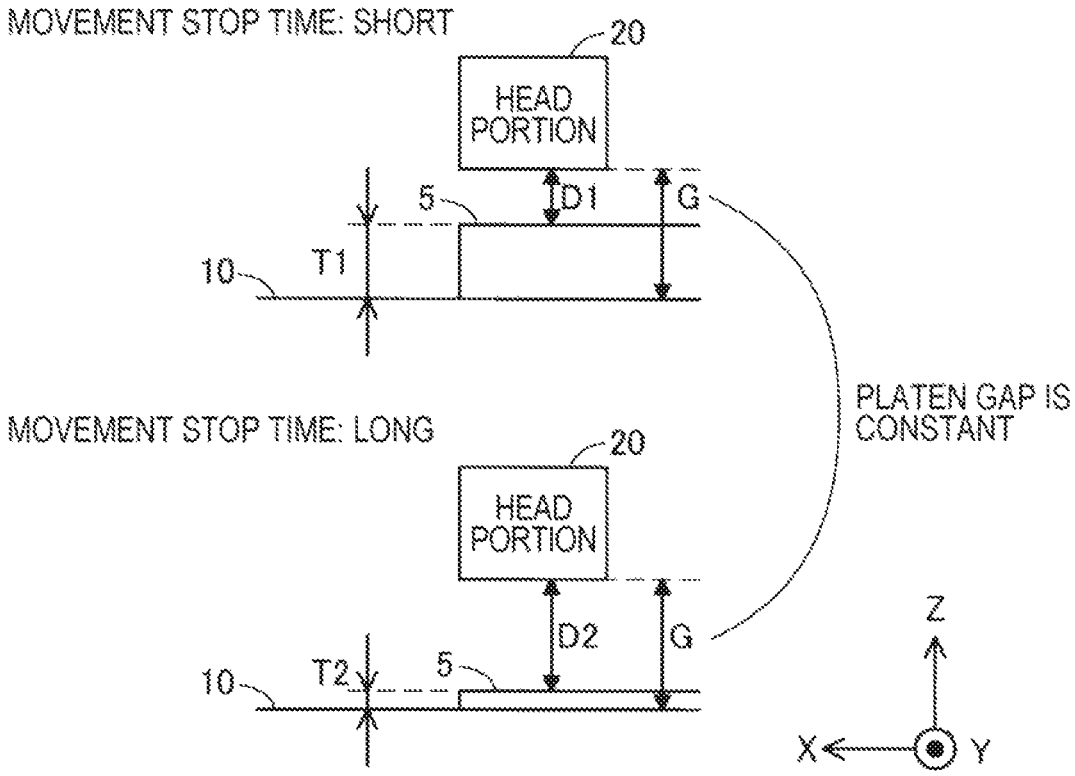
FIG. 8 is a diagram illustrating control contents of a controller according to a third embodiment.

FIG. 8 is a diagram illustrating control contents of the controller 40 according to the present embodiment. In the present embodiment, prior to the printing, the controller 40 measures paper gaps D (D1 and D2) using the distance measuring unit 50 as described above. Thus, the controller 40 controls the movement of the head portion 20 during the printing such that the movement stop time ti of the head portion 20 when the movement direction of the head portion 20 is reversed becomes longer as the paper gap D becomes larger (D2). In this way, since the paper gap is large, even when the airflow between the head portion 20 and the printing medium 5 is not completely attenuated immediately after the movement is stopped during the reverse motion of the head portion 20, the movement stop time ti of the head portion 20 is set to be large, so that the airflow can be sufficiently attenuated. Therefore, influence of the airflow on the ejection of the ink droplets after the reverse motion of the head portion 20 can be suppressed, and the printing quality can be improved.

In the present embodiment, as illustrated in FIG. 8, the platen gap G may be constant irrespective of the thicknesses T1 and T2 of the printing medium 5 or may be different. When the platen gap G is always constant, the printing apparatus 100*a* may not include the interval adjusting mechanism 30.

Figure 9:
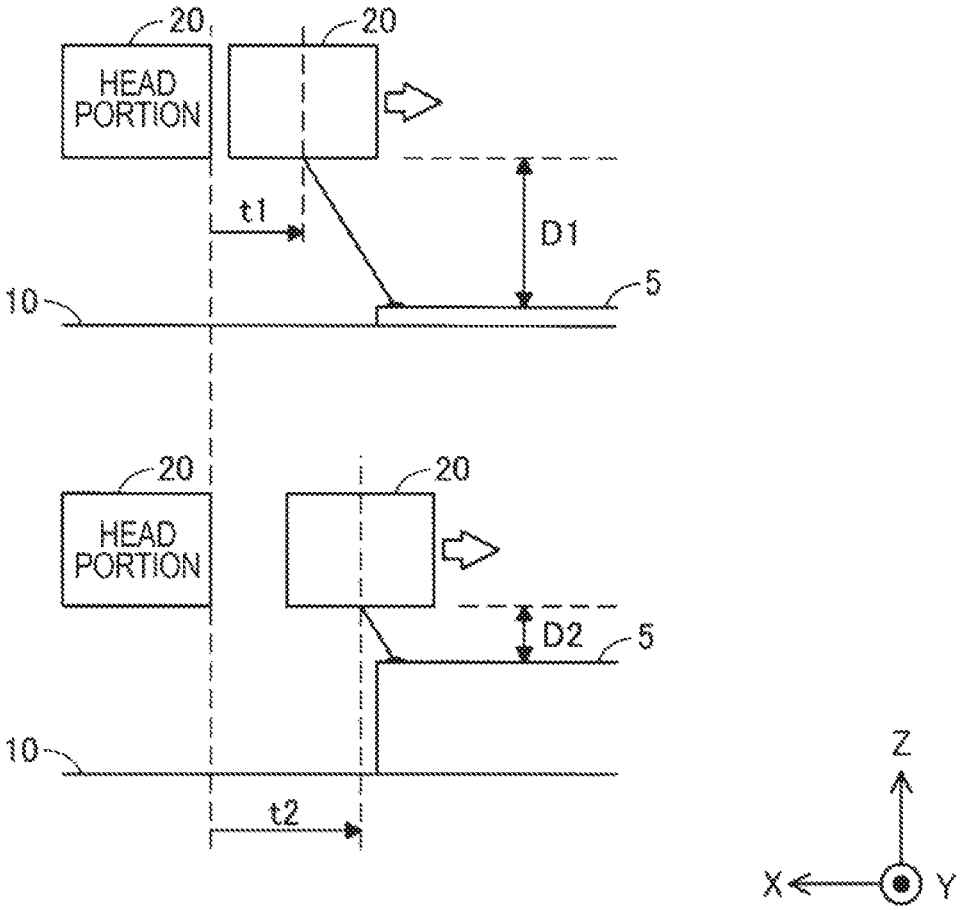
FIG. 9 is a diagram for illustrating an ejection timing of ink droplets from a head portion.

FIG. 9 is a diagram for illustrating an ejection timing of ink droplets from the head portion 20. In the present embodiment, during the printing, as the paper gaps D (D1 and D2) become larger, the controller 40 shortens times t1 and t2 (hereinafter, referred to as an "ejectable time t") at which the ink droplets are ejected to the printing medium 5 after the head portion 20 starts to move after the movement direction of the head portion 20 is reversed (t1<t2). In this way, even when the paper gaps are different, the ink droplets can be appropriately ejected according to the distance between the head portion 20 and the printing medium 5, and a change in a printable range of the printing medium 5 due to a difference between the paper gaps can be suppressed. The controller 40 obtains and determines an optimum ejectable time t according to the paper gaps in a map through experiment and simulation in advance, and sets the optimum ejectable time t according to the paper gaps with reference to the map.

FIG. 9 illustrates an example where the paper gap D becomes different due to a difference in the thickness of the printing medium 5. In contrast, even when the thickness of the printing medium 5 is the same, if the paper gap becomes different due to a difference in the height of the head portion 20 with respect to the platen 10, as the ejectable time t is shortened as the paper gap becomes larger, the ink droplets can be ejected at an appropriate timing, which is like the above control contents.

D. Fourth Embodiment

In the above-described first embodiment, the movement stop time is set according to the printing mode designated by the user. In contrast, in the fourth embodiment, the movement stop time is set based on a position where the head portion 20 is folded back. A configuration of a printing apparatus 100 according to the fourth embodiment is the same as the printing apparatus 100 illustrated in FIG. 1 according to the first embodiment. In the present embodiment, the printing apparatus 100 may not include the interval adjusting mechanism 30.

Figure 10:
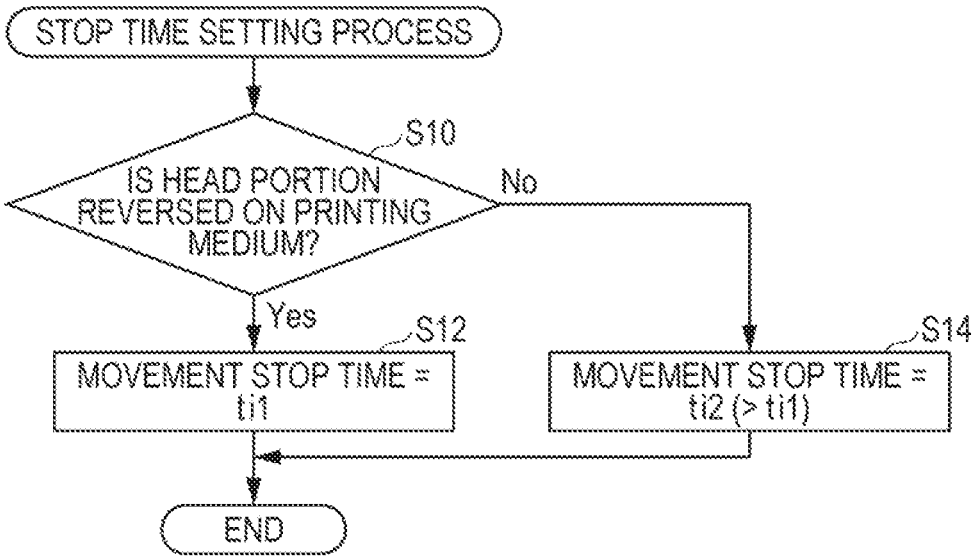
FIG. 10 is a flowchart illustrating a stop time setting process according to a fourth embodiment.
Figure 11:
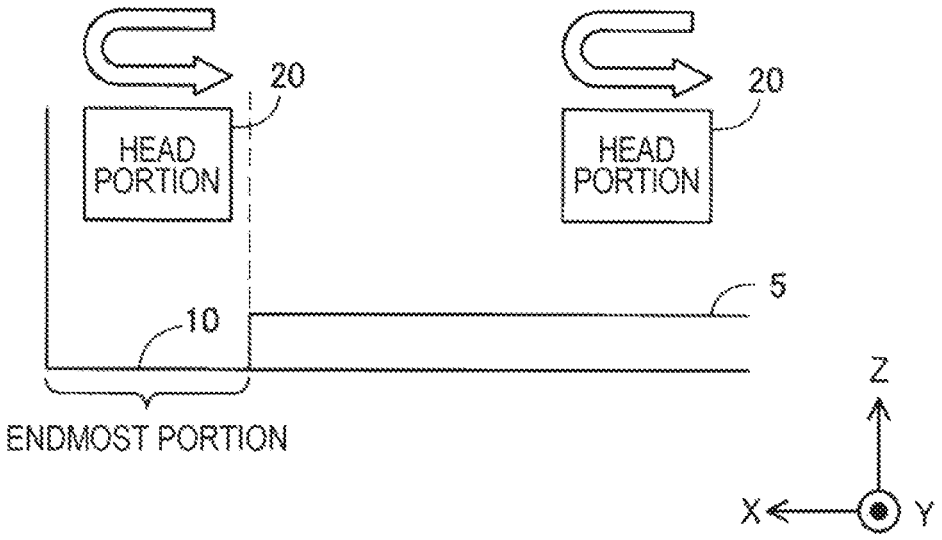
FIG. 11 is a diagram illustrating a position where the head portion is folded back to a printing medium.

FIG. 10 is a flowchart illustrating a stop time setting process executed by the controller 40 according to the fourth embodiment. FIG. 11 is a diagram illustrating a position where the head portion 20 is folded back to a printing medium 5. The stop time setting process illustrated in FIG. 10 is a process executed whenever the head portion 20 is moved forward and rearward during a printing process executed by the controller 40. In more detail, this process is executed during the printing process in the movement direction immediately before the movement direction in which the ink droplets are ejected. That is, for example, when the ink droplets are ejected during the rearward movement, the process is executed during the forward movement, and when the ink droplets are ejected during both the forward movement and the rearward movement, the process is executed at both timings of the forward movement and the rearward movement.

When the stop time setting process is executed, the controller 40 determines whether or not a position where a current movement direction of the head portion 20 is reversed is located on the printing medium 5 (step S10). As illustrated in FIG. 11, in the printing process, the controller 40 reverses the movement direction of the head portion 20 on the printing medium 5 or at an endmost portion of a range in which the head portion 20 can move during the printing operation, in accordance with a position of an endmost portion of an image to be printed in the X direction. Here, in step S10, the controller 40 firstly determines in which position among these positions the head portion 20 is reversed. The "the endmost portion of the range in which the head portion 20 can move during the printing operation" (hereinafter, simply referred to as "the endmost portion") is a position where a process not directly related to the printing is performed, for example, a position excluding a standby position (a home position) of the head portion 20 and a position where the head portion 20 is cleaned. In the present embodiment, when the head portion 20 moves to the endmost portion, the printing medium 5 does not exist directly below the nozzle group 22 provided in the head portion 20.

When it is determined in step S10 that a position where the movement direction of the head portion 20 is reversed is located on the printing medium 5 (step S10: Yes), the controller 40 sets the movement stop time of the head portion 20 to a predetermined time ti1 (step S12). In contrast, when it is determined that the position where the movement direction of the head portion 20 is reversed is not located on the printing medium 5 (step S10: No), the controller 40 sets the movement stop time of the head portion 20 to a time ti2 that is longer than the time ti1 (step S14). As the above-described process is executed during the printing process, the movement of the head portion 20 is controlled such that the movement stop time ti of the head portion 20 when the movement direction of the head portion 20 is reversed at the endmost portion is longer than the movement stop time ti of the head portion 20 when the movement direction of the head portion 20 is reversed on the printing medium 5.

According to the above-described present embodiment, as illustrated in FIG. 11, the movement stop time ti of the head portion 20 is lengthened at the endmost portion at which a space below the head portion 20 is larger than on the printing medium 5. Therefore, in the endmost portion, even when the airflow is not attenuated immediately after the movement is stopped during the reverse motion of the head portion 20, the movement stop time ti of the head portion 20 is lengthened, so that the airflow can be sufficiently attenuated. As a result, influence of the airflow on the ejection of the ink droplets after the reverse motion of the head portion 20 can be suppressed, and the printing quality can be improved. In the present embodiment, a combination of the first to third embodiments can be applied.

E. Fifth Embodiment

Figure 12:
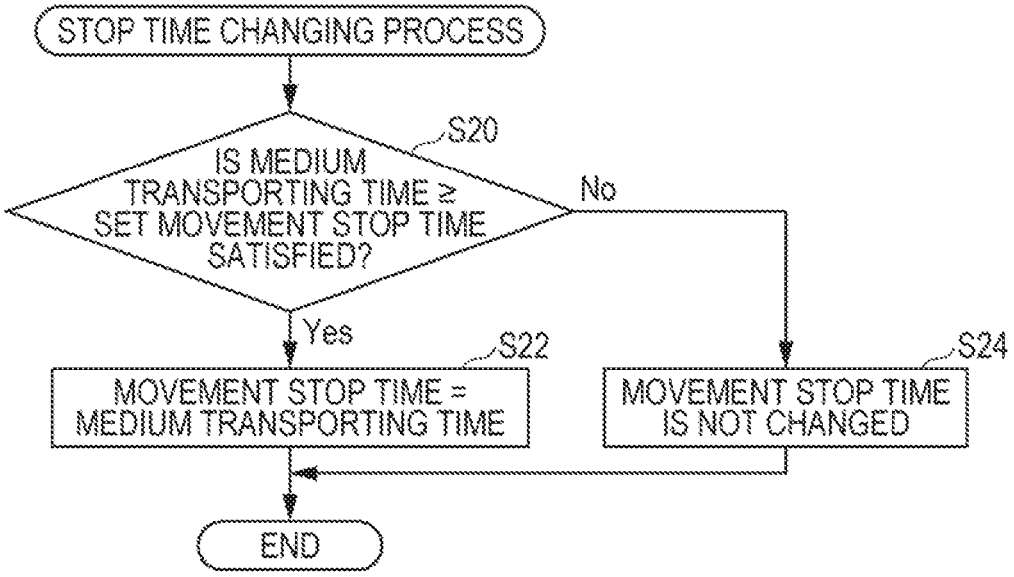
FIG. 12 is a flowchart illustrating a stop time changing process according to a fifth embodiment.

FIG. 12 is a flowchart illustrating a stop time changing process executed by the controller 40 according to the fifth embodiment. This process is a process executed after the movement stop time is once set in each of the above-described embodiments. For example, (1) after the movement stop time is set according to the printing mode when the present embodiment is applied to the first embodiment, (2) after the movement stop time is set according to the platen gap when the present embodiment is applied to the second embodiment, (3) after the movement stop time is set according to the paper gap when the present embodiment is applied to the third embodiment, and (4) after the movement stop time is set according to the position where the head portion 20 is folded back when the present embodiment is applied to the fourth embodiment (after step S12 and step S14 of FIG. 10), the process is executed.

As illustrated in FIG. 12, when the stop time changing process is executed, the controller 40 determines whether or not a medium transporting time is equal to or more than the movement stop time set according to each of the above-described embodiments during the printing process (step S20). The medium transporting time refers to a time consumed for transporting the printing medium 5 by a predetermined distance by the +Y direction using the medium transporting mechanism (the platen roller 11) when the controller 40 reverses the movement direction of the head portion 20. The medium transporting time is a predetermined time for each printing apparatus 100 or each printing mode. For example, in the printing mode having a high printing speed, since a distance by which the printing medium 5 is transported at one time increases, the medium transporting time is lengthened. In the printing mode having high printing quality, since a distance by which the printing medium is transported at one time decreases, the medium transporting time is shortened. During the medium transporting time, the controller 40 stops the movement of the head portion 20, and then transports the printing medium 5.

If the medium transporting time is equal to or more than the set movement stop time (step S20: Yes), the controller 40 changes the movement stop time to the medium transporting time as it is (step S22). In contrast, if the medium transporting time is less than the set movement stop time, the controller 40 does not change the movement stop time (step S24). As the above-described stop time changing process is executed, the controller 40 stops the movement of the head portion 20 for the longer time of the movement stop time of the head portion 20 and the medium transporting time.

According to the above-described present embodiment, if the medium transporting time is sufficiently secured, this time is used as the movement stop time for attenuating the airflow. Thus, the airflow between the head portion 20 and the platen 10 or the printing medium 5 can be sufficiently attenuated within the medium transporting time. Further, when the medium transporting time is less than the set movement stop time, not the medium transporting time but the movement stop time is prioritized, and the movement of the head portion 20 is stopped. Thus, even in this case, the airflow movement between the head portion 20 and the platen 10 or the printing medium 5 can be sufficiently attenuated. Therefore, according to the present embodiment, irrespective of the length of the medium transporting time, the influence of the airflow on the ejection of the ink droplets after the reverse motion of the head portion 20 can be suppressed, and the printing quality can be improved. When the present embodiment is applied to the first to third embodiments, this process may be executed once before the printing process is executed or may be executed whenever the head portion 20 reciprocates.

The invention is not limited to the above-described embodiments, and may be realized in various configurations without departing from the spirit thereof. For example, since the technical features of the embodiments corresponding to the technical features in the modes described in the summary of the Invention are provided to solve some or all of the above-described problems or achieve some or all of the above-described effects, the technical features can be appropriately replaced or combined. Further, unless the technical features are described as essential items in the specification, the technical features may be appropriately deleted.

What is claimed is:

1. A printing apparatus comprising:

a head portion that discharges droplets toward a printing medium while reciprocating on the printing medium;

a controller that controls movement of the head portion during a printing operation such that a movement stop time of the head portion when a movement direction of the head portion is reversed at an endmost portion of a range in which the head portion moves is longer than the movement stop time of the head portion when the movement direction of the head portion is reversed on the printing medium; and a medium transporting mechanism that transports the printing medium in a direction intersecting the movement direction of the head portion, wherein the controller stops the movement of the head portion for a longer time of the movement stop time of the head portion when the movement direction of the head portion is reversed and a medium transporting time required for transporting the printing medium using the medium transporting mechanism when the movement direction of the head portion is reversed.

2. A printing apparatus comprising:

a head portion that discharges droplets toward a printing medium while reciprocating on the printing medium; and a controller that controls the head portion, wherein the controller has a third printing mode in which the head portion moves at a first moving velocity and a fourth printing mode in which the head portion moves at a second moving velocity that is faster than the first moving velocity, and wherein the controller controls movement of the head portion such that a movement stop time of the head portion when a movement direction of the head portion is reversed is longer in the fourth printing mode than in the third printing mode.

* * * * *